US005413890A

United States Patent [19]

Mori et al.

[11] Patent Number: 5,413,890

[45] Date of Patent: May 9, 1995

[54] TONER AND METHOD FOR PRODUCTION THEREOF

[75] Inventors: Yoshikuni Mori, Takatsuki; Mitsuo Kushino, Inagawa, both of Japan

[73] Assignee: Nippon Shokubai, Co., Ltd., Osaka, Japan

[21] Appl. No.: 143,844

[22] Filed: Oct. 28, 1993

[30] Foreign Application Priority Data

Oct. 30, 1992 [JP] Japan ..... 4-293288

[51] Int. Cl.[6] ..... G03G 9/097

[52] U.S. Cl. ..... 430/110; 430/137

[58] Field of Search ..... 430/110, 137

[56] References Cited

U.S. PATENT DOCUMENTS

| | | | |
|---|---|---|---|
| 3,853,778 | 12/1974 | Buckley et al. . | |
| 3,974,078 | 8/1976 | Crystal | 264/122 |
| 4,027,048 | 5/1977 | Crystal | 427/215 |
| 4,514,487 | 4/1985 | Kasuya et al. | 430/137 |
| 5,202,215 | 4/1993 | Kanakura et al. | 430/110 X |

FOREIGN PATENT DOCUMENTS

| | | |
|---|---|---|
| 0509464 | 4/1992 | European Pat. Off. . |
| 63-38953 | 2/1988 | Japan . |
| 2-5071 | 1/1990 | Japan . |
| 25071 | 1/1990 | Japan . |

*Primary Examiner*—Roland Martin

*Attorney, Agent, or Firm*—Omri M. Behr; Matthew J. McDonald

[57] ABSTRACT

This invention discloses a toner characterized by the toner particles thereof severally possessing a sea-island-lake structure wherein a crystalline (meth)acrylic ester type polymer is present in the form of a plurality of domains in a matrix of a binder resin and a portion of the binder resin is present in the form of a plurality of domains in each of the domains of the polymer. The melt viscosity of the crystalline (meth)acrylic ester type polymer is not less than 50 cPs at 140° C. The toner combines an ability to resist the phenomenon of offset with ideal particle flowability, stability of storage, and charging characteristics.

8 Claims, 1 Drawing Sheet

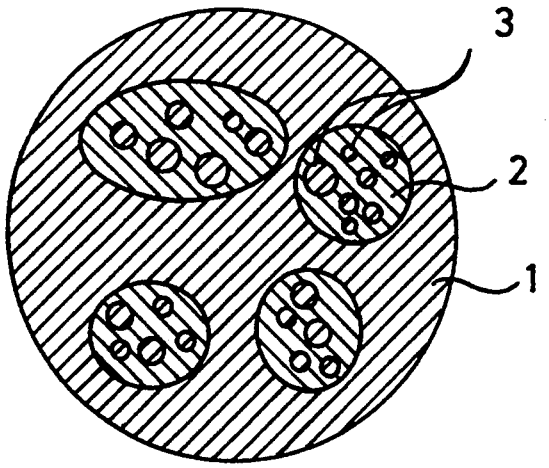
3
2
1

TONER AND METHOD FOR PRODUCTION THEREOF

BACKGROUND OF THE INVENTION

1. Field of the Invention

This invention relates to a toner and a method for the production thereof. More particularly, this invention relates to a toner for developing electrostatic latent images to be formed as by the electrophotographic method, electrostatic recording method, and electrostatic printing method and a method for the production of the toner.

2. Prior Art

For the operation of the photographic method, the heat roller fixing method has been finding growing acceptance as a means for permanently fixing in situ a toner image formed on an image receiving sheet.

This method is ideally suitable for an electrophotographic copying device because it utilizes the pressure contact to be established between the surface of a heat roller and the image surface of a sheet subjected to image fixation and, therefore, excels in the thermal efficiency with which the toner image is thermally fused to the sheet and permits quick fixation. In spite of the advantage mentioned above, this method suffers from a serious problem of entailing the phenomenon of offset. The term "offset" means the phenomenon that, in the process of image fixation, part of the toner forming the image adheres to the surface of a heat roller and this toner transfers onto the next sheet subjected to image fixation and consequently smears the image to be formed thereon.

For the purpose of preventing the phenomenon of offset, such measures as applying silicon oil or a similar substance as a release agent to the heat roller, incorporating such a low melting wax as low molecular polypropylene, low molecular polyethylene, or paraffin wax as a release agent in the toner, and widening the range of molecular weight distribution thereby heightening the cohesive force of molten toner particles have been adopted besides selecting the kind of material for the roller.

In recent years, the desirability of improving the heat roller fixing method in terms of power consumption and speed of fixation has been finding growing recognition. It has been held that the measure of lowering the magnitude of Tg and that of melt viscosity of the toner binder resin is effective in attaining this improvement.

A decrease in the magnitude of Tg of the toner binder resin, however, forms a cause for lowering the stability of storage to resist the phenomenon of blocking or lowering the flowability of toner particles and a decrease in the magnitude of melt viscosity results in rendering the phenomenon of offset more conspicuous.

For the sake of solving these problems, JP-A-2-5,071, for example, proposes a method which comprises adding to a toner composition the oligomer of a crystalline acrylic ester or a crystalline methacrylic ester containing as a component unit thereof such a monomer as stearyl acrylate or stearyl methacrylate. U.S. Pat. No. 4,514,487 likewise discloses a toner which is obtained by polymerizing a polymerizing monomer as a component of a binder resin in the presence of the oligomer of stearyl acrylate or the oligomer of a copolymer containing stearyl acrylate.

Indeed the oligomer of such a crystalline acrylic ester or crystalline methacrylic ester as mentioned above is capable of lowering the minimum fixing temperature of the produced toner because it has a low melting point and a low melt viscosity. When this oligomer is added to the toner binder resin and melted and mixed therewith during the production of the toner, since the difference in melt viscosity between the toner binder resin and the oligomer is large, the oligomer is not thoroughly dispersed in the toner binder resin and the domains of the oligomer present in the matrix of the toner binder resin are relatively large.

When the domains of the oligomer dispersed among the toner particles are large as mentioned above, the disadvantage arises that the resistance offered to the occurrence of the phenomenon of offset owing to the presence of the oligomer is not thoroughly manifested, the flowability of toner particles and the resistance to the phenomenon of blocking are degraded, and the degradation of the flowability retards the initiation of charging of the toner.

SUMMARY OF THE INVENTION

This invention, therefore, has as an object thereof the provision of an improved toner and a method for the production thereof. Another object of this invention is to provide a toner which excels in resistance to offset, flowability, charging property, and stability of storage and a method for the production thereof.

The objects described above are accomplished by a toner which is characterized by the fact that an offset preventing agent selected from the group consisting of crystalline acrylic ester polymers, crystalline methacrylic ester polymers, and copolymers containing at least one of crystalline acrylic esters and crystalline methacrylic esters is present in the form of a plurality of domains within a matrix of a binder resin in a toner particle and another portion of the resin binder is present in the form of a plurality of domains in each of the domains of the offset preventing agent, and the toner particle, therefore, has an sea-island-lake structure, the "sea" being the matrix of the binder resin, the "islands" being the domains of the offset preventing agent, and the "lake" being the domains of the resin binder.

In a preferred embodiment of this invention, the melt viscosity of the offset preventing agent is in the range of 50 cPs to $10^5$ cPs at 140° C.

The offset preventing agent is desired to be contained in the toner composition at a concentration in the range of 0.5 to 30% by weight. The weight average molecular weight of the offset preventing agent is desired to be in the range of 35,000 to 500,000. The melting point of the offset preventing agent is desired to exceed 50° C., preferably to exceed 60° C.

The objects of this invention mentioned above are further accomplished by a method for the production of a toner containing at least a binder resin and a coloring agent, which method is characterized by dissolving an offset preventing agent selected from the group consisting of crystalline acrylic ester polymers, crystalline methacrylic ester polymers, and copolymers containing at least one of crystalline acrylic esters and crystalline methacrylic esters in a polymerizing monomer forming the binder resin in consequence of polymerization and subjecting the resultant polymerizing composition containing the polymerizing monomer mentioned above and the offset preventing agent mentioned above to suspension polymerization in an aqueous medium.

The toner of this invention exhibits ideal resistance to the phenomenon of offset and excels in flowability, stability of storage, and charging property because the dispersibility of the crystalline polymer mentioned above in the toner particles is excellent.

BRIEF DESCRIPTION OF THE INVENTION

FIG. 1 is a sectional view illustrating by means of a model the internal structure of a toner particle of this invention.

DETAILED DESCRIPTION OF THE INVENTION

The toner according with this invention is typically produced by suspension polymerization. It contains as the offset preventing agent a crystalline acrylic ester homopolymer, a crystalline methacrylic ester homopolymer, or a copolymer containing at least either a crystalline acrylic ester monomer or a crystalline methacrylic ester monomer. Hereinafter, the homopolymers and copolymer mentioned above are referred to as "a crystalline (meth)acrylic ester type polymer."

The crystalline (meth)acrylic ester type polymer dissolves in a polymerizing monomer such as, for example, a styrene type monomer or a styrene/acrylic type monomer which forms a binding resin in consequence of polymerization and exhibits substantially no compatibility to the binder resin resulting from the polymerization and undergoes sudden precipitation particularly when the polymerization degree of the binder resin exceeds a prescribed level. When the crystalline (meth)acrylic ester type polymer is added into the polymerizing monomer in the production of the toner particles by suspension polymerization, therefore, it is easily dispersed in the binder resin because it is dissolve, in and uniformly mixed with the polymerizing monomer during the initial stage of polymerization and, with further advance of the polymerization, it is precipitated in the matrix of the binder resin and consequently allowed to form domains clearly demarcated from the binder resin. When the toner is obtained by the method of suspension polymerization described above, the toner particle thereof illustrated in the form of a model in FIG. 1 has a plurality of domains 2 of the crystalline (meth)acrylic ester type polymer formed in a matrix 1 of the binder resin and further has a plurality of domains 3 of another portion of the binder resin in each of the domains 2 so that the toner particle acquires a sea-island-lake structure. The mechanism which is responsible for the formation of the sea-island-lake structure just mentioned still defies elucidation. At any rate, the crystalline (meth)acrylic ester type polymer exhibits ideal dispersibility in the toner particles.

The toner according with this invention possesses high releasbility and excels in resistance to the phenomenon of offset because the crystalline (meth)acrylic ester type polymer contained in the toner has a relatively low melting point and contains a long chain alkyl group. Further, since the crystalline (meth)acrylic ester type polymer exhibits ideal dispersibility in the toner particles of this invention and forms sufficiently small domains therein as described above, it has virtually no effect on the flowability of toner particles and, as a result, the toner particles enjoy ideal flowability permit ideal initiation of charging.

The crystalline (meth)acrylic ester type polymer to be used as the offset preventing agent for the toner of this invention contains a monomer represented by the following general formula (I) as a component unit in an amount in the range of 100 to 50 mol %, desirably 100 to 60 mol %, and more desirably 100 to 70 mol %.

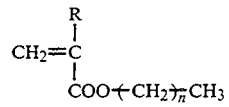

(I)

(wherein R stands for a hydrogen atom or a methyl group and n for an integer in the range of 15 to 32, desirably 18 to 32, and more desirably 21 to 32).

As concrete examples of the monomer represented by the general formula (I) shown above, stearyl acrylate, stearyl methacrylate, hexadecyl acrylate, hexadecyl methacrylate, heptadecyl acrylate, heptadecyl methacrylate, nonadecyl acrylate, nonadecyl methacrylate, aralkyl acrylates, aralkyl methacrylates, behenyl acrylate, behenyl methacrylate, pentacyl acrylate, pentacyl methacrylate, heptacyl acrylate, and heptacyl methacrylate, nonacyl acrylate, nonacyl methacrylate, doteriacyl acrylate, and doteriacyl methacrylate may be cited. Among other monomers mentioned above, stearyl acrylate, behenyl acrylate, behenyl methacrylate, pentacyl acrylate, and pentacyl methacrylate prove to be particularly desirable.

As concrete examples of the monomer which is copolymerizable with the monomer represented by the general formula (I), styrene type monomers such as styrene, o-methyl styrene, m-methyl styrene, p-methyl styrene, $\alpha$-methyl styrene, p-methoxy styrene, p-tert-butyl styrene, p-phenyl styrene, o-chlorostyrene, m-chlorostyrene, and p-chlorostyrene; amorphous acrylic ester type or amorphous methacrylic ester type monomers such as methyl acrylate, ethyl acrylate, n-butyl acrylate, isobutyl acrylate, dodecyl acrylate, n-octyl acrylate, 2-ethylhexyl acrylate, phenyl acrylate, $\alpha$-chloromethyl acrylate, ethyl methacrylate, propyl methacrylate, propyl methacrylate, n-butyl methacrylate, isobutyl methacrylate, n-octyl methacrylate, dodecyl methacrylate, and 2-ethylhexyl methacrylate; acrylic acid type monomers such as acrylonitrile, methacrylonitrile, and acrylamide; vinyl ether type monomers such as vinyl methyl ether, vinyl isobutyl ether, and vinyl ethyl ether; vinyl ketone type monomers such as vinyl methyl ketone, vinyl ethyl ketone, and vinyl hexyl ketone; N-vinyl compound type monomers such as N-vinyl pyrrole, N-vinyl carbazole, N-vinyl indole, and N-vinyl pyrrolidone; and various vinyl type monomers such as ethylene, propylene, butylene, vinyl chloride, and vinyl acetate may be cited.

The weight average molecular weight of such a crystalline (meth)acrylic ester type polymer is in the approximate range of 35,000 to 500,000, desirably 35,000 to 450,000, and more desirably 35,000 to 400,000. If the weight average molecular weight is less than 35,000, the possibility arises that the melt viscosity of the offset preventing agent is too low for the produced toner to produce the desired effect of preventing the phenomenon of offset and the crystalline (meth)acrylic ester type polymer in the toner particles fails to acquire satisfactory dispersibility and satisfactory stability of storage. If the weight average molecular weight conversely exceeds the upper limit of the range mentioned above, the possibility that the offset preventing agent will exhibit unduly high melt viscosity and unduly poor melt characteristics and the produced toner will fail to manifest the expected offset preventing property is great.

The melt viscosity of the crystalline (meth)acrylic ester type polymer which is measured with a B-type viscosimeter at 140° C. is desired to be in the range of 50 cPs to $2\times10^5$ cPs, and preferably 100 cPs to $1\times10^5$ cPs. If the melt viscosity is less than 50 cPs at 140° C., the possibility ensues that the offset resisting effect of the toner, the satisfactory dispersibility of the crystalline polymer in the toner particles, and the satisfactory stability of storage of the toner will not be attained as contemplated. Conversely, if the melt viscosity exceeds $1\times10^5$ cPs, the possibility arises that the melt characteristics of the offset preventing agent will be unduly inferior and the produced toner will fail to manifest the expected offset preventing property.

Further, the melting point of the crystalline (meth)acrylic ester type polymer is required to be not less than 35° C. and is generally desired to be not less than 50° C., preferably to be not less than 60° C. If the melting point of the polymer is less than 35° C., the toner fails to manifest the expected stability of storage even in a relatively moderate environment. With respect to certain harsh conditions, it is considered necessary for the melting point to be not less than 50° C. From the standpoint of enabling the produced toner to acquire a satisfactory offset resisting property, the upper limit of the melting point is desired to be set at 120° C., preferably in the neighborhood of 100° C. The most desirable range of the melting point of the crystalline (meth)acrylic ester type polymer to be used in this invention is 60° to 100° C. The term "melting point (Tm)" as used in the present specification refers to the peak (maximum) value of melting to be determined by the method of differential scanning calorimetry (DSC) as with a differential scanning calorimeter (produced by Perkin Elmer Corp. and marketed under trademark designation of "DSC-7"), heating a sample about 20 mg in amount at a fixed temperature increasing rate of 10° C./min.

The toner of this invention is desired to incorporate therein the crystalline (meth)acrylic ester type polymer in an amount in the range of 0.5 to 30% by weight, preferably 1 to 15% by weight, based on the amount of the toner composition containing at least a binder resin and a coloring agent which will be specifically described hereinafter. If the amount of the polymer so incorporated is less than 0.5% by weight, the produced toner acquires an amply improved offset resisting property with difficulty. Conversely, if this amount exceeds 30% by weight, the possibility that the thermally fixing property of the toner, the flowability of the toner particles, and the efficiency of initiation of charging will be degraded is large.

The binder resin for the toner of this invention may be any of the various resins which have been heretofore adopted for the production of a toner by suspension polymerization of the kind mentioned above. The polymerizing monomer destined to form the binding resin is desired to be capable of dissolving the crystalline (meth)acrylic ester type polymer described above in the range of polymerization temperature and the polymer formed by the polymerization of the monomer is desired to be incapable of exhibiting substantial compatibility to the crystalline (meth)acrylic ester type polymer. Homopolymers or copolymers of polymerizing monomers mentioned above, particularly styrene type resins or styrene/acryl type resins, and preferably styrene type resins or styrene/acryl type resins having weight average molecular weights in the approximate range of 2,000 to $5\times10^5$ are advantageously used.

The coloring agent to be used in the toner of the present invention may be selected from among the dyes and pigments which have been universally known to persons of ordinary skill in the art. The discrimination between organic and inorganic species is irrelevant. As concrete examples of the coloring agent usable effectively herein, carbon black, nigrosine dyes, aniline blue, chalco-oil blue, chrome yellow, ultramarine blue, DuPont oil red, quinoline yellow, methylene blue chloride, phthalocyanine blue, Malachite green oxalate, lamp black, oil black, azo oil black, and rose bengal may be cited. It is permissible to use two or more of these coloring agents in a combined form when necessary.

The magnetic powders which are effectively usable in producing a magnetic species of the toner of this invention include powders of such ferromagnetic metals as iron, cobalt, and nickel and powders of such metallic compounds as magnetite, hematite, and ferrite, for example. Since these magnetic powders function additionally as a coloring agent, they may be used singly. Of course, they may be used in combination with such coloring agents as cited above.

These coloring agents and/or magnetic powders may be used in their unmodified form. When such a coloring agent and/or a magnetic powder is given a surface treatment performed by a suitable method and then put to use, the toner to be produced consequently is at an advantage in having the coloring agent and/or magnetic powder uniformly dispersed therein and permitting formation of an image of high quality. When carbon black is used as the coloring agent, for example, the carbon black graft polymer disclosed in U.S. Pat. No. 4,880,857, U.S. Pat. No. 4,940,749, and U.S. Pat. No. 4,994,520 proves to be ideally usable. When a coloring agent other than carbon black is used, the surface-treated coloring agent which is obtained by the method disclosed in JP-A-1-118,573 proves to be ideally usable. These are incorporated herein by reference.

The amount of the coloring agent and/or magnetic powder mentioned above can be varied in a wide range, depending on the kind of the coloring agent and/or magnetic powder and the kind of the toner desired to be obtained. Desirably, it is in the range of 1 to 70% by weight, preferably 1 to 60% by weight, based on the amount of the toner composition.

The toner of this invention is allowed, when necessary, to have such well-known toner grade additives as charge control agent, flowability enhancing agent, and wax added to the interior or the surface region of the toner particles.

As concrete examples of the charge control agent, nigrosine, monoazo dyes, zinc, hexadecyl succinate, alkyl esters or alkylamides of naphthoeic acid, nitrohumic acid, N,N-tetramethyl diamine benzophenone, N,N-tetramethyl benzine, triazine, and metal complexes of salicylic acid may be cited.

The flowability enhancing agents which are effectively usable herein include silica, aluminum oxide, titanium dioxide, and magnesium fluoride may be cited.

As concrete examples of the wax effectively usable herein, polymers having softening points of 80° to 180° C. as measured by the ring furnace method, paraffin waxes having high melting points of 60° to 70° C., aliphatic esters and products of partial saponification thereof, higher fatty acids, metal salts of fatty acids, and higher alcohols may be cited. Among other waxes cited above, polyolefin type waxes such as polyethylene and polypropylene prove to be particularly desirable. When such a wax is added to the toner of this invention in an unduly large amount, the possibility of the added wax appreciably impairing the characteristics of the toner such as flowability and efficiency of initiation of charging is great. The amount of the wax to be added, therefore, is desired to be not more than 100% by weight, preferably not more than 50% by weight, based on the amount of the crystalline (meth)acrylic ester type polymer which is incorporated in the toner.

The toner according with this invention can be produced typically by adding the crystalline (meth)acrylic ester type polymer mentioned above to the polymerizing monomer destined to form a binder resin in consequence of polymerization as described above, optionally heating the resultant mixture to a temperature equaling or not exceeding the polymerization initiating point thereby dissolving the crystalline (meth)acrylic ester type polymer in the polymerizing monomer mentioned above, and then subjecting the mixture to suspension polymerization in an aqueous medium.

Generally, the coloring agent and/or the magnetic powder has been preparatorily dispersed or dissolved in the polymerizing monomer mentioned above before the suspension polymerization is initiated. There are times, however, when the preparatory dispersion or dissolution is not made and the coloring agent and/or the magnetic powder may be imparted by a suitable method to the spherical polymer particles to be obtained by polymerizing the polymerizing monomer. Further, the other additives such as the charge control agent which are optionally incorporated in the toner particles may be generally dispersed or dissolved in the polymerizing monomer prior to the suspension polymerization. They may be otherwise added to the polymerizing monomer by a suitable method subsequently to the suspension polymerization.

The suspension polymerization is desired to be carried out either after or during the regulation of particle diameter, preferably after the regulation of particle diameter. This regulation of particle diameter is effected by causing the suspension of prescribed components in an aqueous medium to pass at least once through a line mixer such as a T. K. Homomixer or Ebara Milder.

The reaction of suspension polymerization is generally carried out at a temperature in the range of 40° to 130° C., preferably 50° to 90° C., for a period in the range of 0.5 to 30 hours, preferably 2 to 10 hours.

The stabilizers which are effectively usable for the suspension polymerization include water-soluble macromolecular compounds such as polyvinyl alcohol, starch, methyl cellulose, carboxymethyl cellulose, hydroxyethyl cellulose, sodium polyacrylate, and sodium polymethacrylate; surfactants such as anionic surfactants, cationic surfactants, amphoteric surfactants, and nonionic surfactants; and barium sulfate, calcium sulfate, barium carbonate, magnesium carbonate, calcium phosphate, clay, diatomaceous earth, and metal oxide powders, for example.

As concrete examples of the anionic surfactant, fatty acid salts such as sodium oleate and potash castor oil, alkyl sulfuric esters such as sodium lauryl sulfate and ammonium lauryl sulfate, alkylbenzene sulfonates such as sodium dodecylbenzene sulfonate, alkylnaphthalene sulfonates, alkane sulfonates, dialkyl sulfosuccinates, alkyl phosphoric esters, naphthalene sulfonic acid formalin condensate, polyoxyethylene alkylphenyl ether sulfuric esters, and polyoxyethylene alkyl sulfuric esters may be cited.

As concrete examples of the nonionic surfactant, polyoxy ethylene alkyl ethers, polyoxy ethylene alkylphenyl ethers, polyoxy ethylene fatty acid esters, sorbitan fatty acid esters, polyoxy sorbitan fatty acid esters, polyoxy ethylene alkyl amines, oxyethyleneoxypropylene block copolymer may be cited.

As concrete examples of the cationic surfactant, alkyl amine salts such as lauryl amine acetate and stearyl amine acetate and quaternary ammonium salts such as lauryl trimethyl ammonium chloride may be cited.

Amphoteric ionic surfactants are represented by lauryl dimethyl amine oxide.

These stabilizers ought to be used with the composition and the amount of use suitably adjusted so that the spherical resin particles to be obtained will have a particle diameter in the range of 3.5 to 20 μm, preferably 4 to 15 μm. When a water-soluble macromolecular compound is used as a stabilizer, for example, the amount of this compound to be suitably used is in the range of 0.01 to 20% by weight, preferably 0.1 to 10% by weight, based on the amount of the polymerizing monomer. When a surfactant is used instead, the amount of the surfactant to be suitably used is in the range of 0.01 to 10% by weight, preferably 0.1 to 5% by weighty based on the amount of the polymerizable monomer.

As the polymerization initiator, an oil-soluble peroxide type or azo type initiator which is generally used for suspension polymerization can be utilized. As concrete examples of the polymerization initiator, peroxide type initiators such as benzoyl peroxide, lauroyl peroxide, octanoyl peroxide, benzoyl orthochloroperoxide, benzoyl orthomethoxyperoxide, methylethyl ketone peroxide, diisopropyl peroxy dicarbonate, cumene hydro peroxide, cyclohexanone peroxide, t-butyl hydro peroxide, and diisopropyl benzene hydro peroxide and 2,2'-azo-bis-isobutyro nitrile, 2,2'-azo-bis-(2,4-dimethyl valero nitrile), 2,2'-azo-bis-2,3-dimethyl butyronitrile, 2,2'-azo-bis-(2-methyl butyro nitrile), 2,2'-azo-bis-2,3,3-trimethyl butyro nitrile, 2,2'-azo-bis-2-isopropyl butyro nitrile, 1,1'-azo-bis-(cyclohexane-1-carbo nitrile), 2,2'-azo-bis-(4-methoxy-2,4-dimethyl valero nitrile), 2-(carbamoyl azo)-isobutyro nitrile, 4,4'-azo-bis-4-cyano valeric acid, and dimethyl-2,2'-azo-bis-isobutylate may be cited. The polymerization initiator is desired to be used in an amount in the range of 0.01 to 20% by weight, preferably 0.1 to 10% by weight, based on the amount of the polymerizing monomer.

When the polymerizing monomer component is to be suspension polymerized to produce minute resin particles, it may suitably incorporate therein such known additives as a chain transfer agent for the purpose of adjusting the polymerization degree.

The toner particles which are present in the aqueous medium at the end of the suspension polymerization are separated from the aqueous medium and dried. During the separation of the toner particles from the aqueous medium, the toner particles may be subjected to a treatment of flocculation, when necessary, by the use of a flocculant. The toner particles which have been separated and dried may be subjected to a treatment of disintegration.

The flocculants which are effectively usable for the treatment of flocculation include well-known flocculants such as inorganic acids represented by hydrochloric acid, organic acids represented by acetic acid, and water-soluble metal salts of such acids as mentioned above with alkaline earth metal salts and aluminum, and such organic solvents which are non-solvents for water-insoluble minute particles and/or binder resin as described in JP-A-5-40365, for example.

The toner particles which are obtained consequently have a mean particle diameter in the range of 3.5 to 20 μm, preferably 4 to 15 μm. Finally, the toner particles which are thus obtained may be subjected, when necessary, to a treatment for deposition of such additives as a flowability enhancing agent which are generally added to the surface region of toner particles.

EXAMPLES

Now, this invention will be described more specifically below with reference to working examples. It should be noted, however, that this invention is not limited to these examples. Wherever "parts" is mentioned in the following examples and controls, it is meant to refer to "parts by weight" unless otherwise specified.

Example 1

A reaction kettle provided with a stirrer, an inert gas inlet pipe, a reflux condenser, and a thermometer was charged with 2,000 parts of deionized water having 1 part of polyvinyl alcohol dissolved therein. In the reaction kettle, the deionized water and a mixture prepared in advance by dissolving 80 parts of benzoyl peroxide in a polymerizing monomer consisting of 585 parts of styrene, 390 parts of butyl methacrylate, and 25 parts of glycidyl methacrylate were combined and stirred at a high speed to form a uniform suspension. Then, the suspension was blown with a stream of nitrogen gas and heated to 80° C., stirred at this temperature continuously for five hours to induce a reaction of polymerization, and subsequently stripped of water to afford a polymer having an epoxy group as a reactive group.

By the use of a pressure kneader, 400 parts of the polymer having an epoxy group as a reactive group, 180 parts by carbon black (produced by Mitsubishi Chemical Industries, Ltd. and marketed under product code of "MA-100R"), and 20 parts of a charge control agent (produced by Hodogaya Chemical Co., Ltd. and marketed under trademark designation of "Aizen Spilon Black TRH") were kneaded and allowed to react under the conditions of 160° C. and 100 rpm. The resultant reaction mixture was cooled and pulverized to obtain a carbon black graft polymer containing the charge control agent as a coloring agent.

A mixer provided with a stirrer was charged with a polymerizing monomer consisting of 80.5 parts of styrene, 15 parts of n-butyl acrylate, and 0.42 part of divinyl benzene. Then, 1.5 parts of polybehenyl acrylate (melting point (peak temperature determined by the DSC method) 69° C., molecular weight (Mw) 50,000, and melt viscosity (at 140° C.) 200 cPs) was added to the monomer in the mixer.

The mixture in the mixer was combined with 50 parts of the carbon black graft polymer obtained as described above containing the charge control agent, 2 parts of azo-bis-isobutyro nitrile, and 4 parts of 2,2'-azo-bis(2,4-dimethyl) valeronitrile and the produced blend was dissolved to obtain a polymerizing monomer composition. The monomer composition and 500 parts of deionized water having 0.4 part of an anionic surfactant (produced by Dai-ichi Kogyo Seiyaku Co., Ltd. and marketed under trademark designation of "Hitenol N-08") dissolved in advance therein were mixed and stirred to form a uniform suspension. This suspension was passed once through a pulverizer (produced by Ebara Mfg. Co., Ltd. and marketed under trademark designation of "Ebara Milder MDN-303) operated at a rate of 15,000 rpm to obtain a suspension of minute particles of a regulated diameter.

In the same reaction kettle as mentioned above, the suspension was placed, blown with a stream of nitrogen gas and, at the same time, heated to 75° C., and stirred at this temperature continuously for four hours to induce suspension reaction. As a result, a suspension (1) of minute spherical colored particles having a polymerization ratio of 99.9%, a volume arithmetic mean diameter of 4.9 μm, and a coefficient of variation of particle diameter of 14.2% was obtained. When the suspension (1) of minute spherical colored particles kept at 75° C. and 0.2 part of aluminum chloride added thereto were in situ heat-treated for wet fusion at the same temperature for one hour, the particles were agglomereted and the surface regions of the particles were fused to form blocks of the particles. The blocks were separated by filtration, washed, and dried with a vacuum drier at 50° C. for eight hours. The blocks were disintegrated by the use of a supersonic jet pulverizer (produced by Nippon Pneumatic Kogyo K. K.) to obtain minute colored particles (1). With the aid of a coal counter (aperture 100 μm), the minute colored particles (1) were found to have a volume arithmetic mean diameter of 5.1 μm and a coefficient of variation of particle diameter of 13.1%.

The minute colored particles (1) obtained as described above were dispersed in an epoxy type resin. The resultant composite was hardened and sliced with a microtome into sections 0.05 mm in thickness. When a sample section was observed by means of a transmission type electron micrograph (TEM), it was found as illustrated in the form of a model in FIG. 1 to have domains 2 of the aforementioned crystalline polybehenyl acrylate formed in a matrix 1 of binder resin and further have domains 3 of binder resin formed in each of the domains 2 in a sea-island-lake structure.

An electrostatic developer toner (1) was produced by adding 0.5 part of aerosil (produced by Nippon Aerosil K. K. and marketed under product code of "R972") to 100 parts of the minute colored particles (1). When this electrostatic developer toner (1) was used in a commercially available copying device (produced by Ricoh Company Ltd. and marketed under product code of "Type 4060") to reproduce a given image on 5,000 sheets of recording paper, ideal copied images were obtained without entailing the phenomenon of offset.

To test the minute colored particles (1) for ability to resist heat, 20 g of the minute colored particles (1) were placed in a sample tube, sealed therein airtightly, left standing at a temperature of 60° C. for 24 hours, and examined as to the degree of agglomeration. The results are shown in Table 1.

Example 2

A polymer-treated magnetic mass was obtained by kneading 200 parts of the polymer having an epoxy group obtained by the method of Example 1 with 380 parts of a powdery magnetic substance (produced by Titan Kogyo K. K. and marketed under trademark designation of "Mapiko BL-200") and 20 parts of a charge control agent (Aizen Spilon Black TRH) by the use of a pressure kneader under the conditions of 160° C. and 100 rpm, cooling the resultant blend, and pulverizing the cooled blend.

A suspension (2) of minute spherical colored particles having a polymerization ratio of 99.8%, a volume arithmetic mean diameter of 5.45 μm, and a coefficient of variation of particle diameter of 22.6% was obtained by suspension polymerization carried out by following the procedure of Example 1, excepting 500 parts of the polymer-treated magnetic mass and 6 parts of polybehenyl methacrylate (melting point (peak temperature determined by the DSC method) 62° C., molecular weight (Mw) 180,000, and melt viscosity (140° C.) 3,900 cPs) were used instead.

The suspension (2) of minute spherical colored particles was subjected to heat treatment for wet fusion, filtration, washing, drying, and pulverization with a supersonic jet pulverizer in the same manner as in Example 1. Consequently, minute colored particles (2) having a volume arithmetic mean diameter of 5.25 μm and a coefficient of variation of particle diameter of 19.4% were obtained.

An electrostatic developer toner (2) was produced by adding 0.5 part of aerosil (R972) to 100 parts of the minute colored particles (2). When this electrostatic developer toner (2) was used in a commercially available copying device (produced by Canon Inc. and marketed under product code of "NP-5000") to reproduce a given image on 5,000 sheets of recording paper, ideal copied images were obtained without entailing the phenomenon of offset.

The minute colored particles (2) were tested for ability to resist heat in the same manner as in Example 1. The results are shown in Table 1.

Example 3

A suspension (3) of minute spherical colored particles having a polymerization ratio of 99.7%, a volume arithmetic mean diameter of 5.0 μm, and a coefficient of variation of particle diameter of 14.3% was obtained by suspension polymerization carried out by following the procedure of Example 1, excepting 4.5 parts of polystearyl acrylate (melting point (peak temperature determined by the DSC method) 53° C., molecular weight (Mw) 95,000, and melt viscosity (140° C.) 444 cPs) was used in the place of 1.5 parts of polybehenyl acrylate.

Minute colored particles (3) having a volume arithmetic mean diameter of 5.2 μm and a coefficient of variation of particle diameter of 13.5% were obtained by subjecting the suspension (3) of minute colored particles to the procedure of Example 1.

An electrostatic developer toner (3) was produced by adding 0.5 part of aerosil R972 to 100 parts of the minute colored particles (3). When the electrostatic developer toner (3) was tested in the same manner as in Example 1, ideal copied images were obtained without entailing the phenomenon of offset.

The minute colored particles (3) were tested for ability to resist heat in the same manner as in Example 1. The results are shown in Table 1.

Example 4

A suspension (4) of minute spherical colored particles having a polymerization ratio of 99.8%, a volume arithmetic mean diameter of 4.9 μm, and a coefficient of variation of particle diameter of 14.1% was obtained by suspension polymerization carried out by following the procedure of Example 1, excepting 1 part of polystearyl methacrylate (melting point (peak temperature determined by the DSC method) 37.8° C., molecular weight (Mw) 256,000 and melt viscosity (140° C.) 6,800 cPs) was used in the place of 1.5 parts of polybehenyl acrylate.

Minute colored particles (4) having a volume arithmetic mean particle of 5.0 μm and a coefficient of variation Of particle diameter of 13.0% were obtained by subjecting the suspension (4) of minute colored particles in the same manner as in Example 1.

An electrostatic developer toner (4) was produced by adding 0.5 part of aerosil R972 to 100 parts of the minute colored particles (4). When the electrostatic developer toner (4) was tested in the same manner as in Example 1, ideal copied images were obtained without entailing the phenomenon of offset.

The minute colored particles (4) were tested for ability to resist heat in the same manner as in Example 1. The results are shown in Table 1.

Control 1

Minute colored particles (a) for comparison were obtained by following the procedure of Example 1, excepting a polymerizing monomer composition prepared by mixing and dispersing 15 parts of carbon black MA 600, 1.7 parts of a charge control agent (Aizen Spilon Black TRH), and 7.5 parts of low molecular polypropylene (produced by Sanyo Chemical Industries Co., Ltd. and marketed under trademark designation of "Viscol 550P") in a polymerizing monomer consisting of 105.8 parts of styrene, 20 parts of n-butyl acrylate, and 0.45 part of divinyl benzene in a ball mill for 200 hours and then dissolving 2.5 parts of azo-bis isobutyro nitrile and 5 parts of 2,2'-azo-bis(2,4-dimethyl valeronitrile) in the resultant dispersion was used in the place of the polymerizing monomer composition of Example 1. Then, an electrostatic developer toner (a) for comparison was produced by adding aerosil R971 to the minute colored particles (a) in the same manner as in Example 1.

When the electrostatic developer toner (a) for comparison was used in a commercially available copying device (produced by Ricoh Company Ltd. and marketed under product code of "Type 406") operated to copy a given image on successive sheets of recording paper, the phenomenon of offset appeared on the tenth sheet. In the image copied on the tenth sheet, white portions were observed to be stained. When the copying device was opened to inspect the interior thereof, the interior showed a sign of toner scattering.

The minute colored particles (a) for comparison were tested for ability to resist heat in the same manner as in Example 1. The results are shown in Table 1.

Control 2

Minute colored particles (b) for comparison were obtained by following the procedure of Example 3, excepting 4.5 parts of stearyl acrylate oligomer (melting point (peak temperature determined by the DSC method) 53° C., molecular weight, Mw, 10,000, and melt viscosity (140° C.) 20 cPs) was used in the place of 4.5 parts of polystearyl acrylate of Example 3

An electrostatic developer toner (b) for comparison was obtained by adding aerosil R972 to the minute colored particles (b) for comparison in the same manner as in Example 3. When this toner was used in a commercially available copying device (produced by Ricoh Co., Ltd. and marketed under product code of "Type 4060") operated to copy a given image on successive sheets of recording paper, the phenomenon of offset appeared on the second sheet.

Control 3

Minute colored particles (c) for comparison were obtained by following the procedure of Example 3, excepting the addition of polystearyl acrylate of Example 3 was omitted.

An electrostatic developer toner (c) for comparison was produced by adding aerosil R971 to the minute colored particles (c) for comparison in the same manner as in Example 1. When this toner was used in a commercially available copying device (produced by Ricoh Co., Ltd. and marketed under product code of "Type 4060") operated to copy a given image on successive sheets of recording paper, the phenomenon of offset appeared on the second sheet.

TABLE 1

| Evaluation of ability to resist heat | |
|---|---|
| Example 1 | ◎ |
| Example 2 | ◎ |
| Example 3 | ○ |
| Example 4 | Δ |
| Control 1 | ○ |
| Control 2 | X |
| Control 3 | X |

The ability to resist heat was rated on a four-point scale wherein:

◎ stands for absence of agglomeration

○ stands for partial agglomeration which was disintegrated by gentle shaking

Δ stands for partial agglomeration which was disintegrated by vigorous shaking

X stands for fast agglomeration which defied disintegration

What is claimed is:

1. A toner comprising toner particles containing at least a coloring agent, a binder resin, and an offset preventing agent; wherein said offset preventing agent is selected from the group consisting of crystalline acrylic ester polymers, crystalline methacrylic ester polymers, and copolymers containing at least one of crystalline acrylic esters and crystalline methacrylic esters, and is present in the form of a plurality of domains in a matrix of said binder resin in each of said toner particles; wherein another portion of said binder resin is present in the form of a plurality of domains in each of said domains of offset preventing agent; wherein said toner particles therefore assume a sea-island-lake structure; and wherein the weight average molecular weight of said offset preventing agent is in the range of 35,000 to 500,000, and the melting point of said offset preventing agent is in the range of 35° to 120° C.

2. A toner according to claim 1, wherein the melt viscosity of said offset preventing agent is in the range of 50 cPs to $10^5$ cPs at 140° C.

3. A toner according to claim 1, wherein the toner composition contains said offset preventing agent at a concentration in the range of 0.5 to 30% by weight.

4. A toner according to claim 1, wherein said offset preventing agent contains as a component unit thereof a monomer represented by the following general formula (I) at a concentration in the range of 100 to 50 mol %.

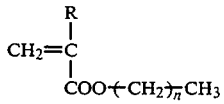

(I)

(wherein R stands for a hydrogen atom or a methyl group and n for an integer in the range of 15 to 32).

5. A toner according to claim 1, wherein said binder resin is one of styrene resin and styrene/acryl resin.

6. A toner according to claim 1, wherein a graft carbon black polymer is contained as a coloring agent.

7. A method for the production of a toner according to claim 1, characterized by dissolving an offset preventing agent selected from the group consisting of crystalline acrylic ester polymers, crystalline methacrylic ester polymers, and copolymers containing at least one of crystalline acrylic esters and crystalline methacrylic esters in a polymerizing monomer destined to form a binder resin in consequence of polymerization and suspension polymerizing the resultant polymerizing composition containing at least said polymerizing monomer and offset preventing agent in an aqueous medium.

8. A toner composition according to claim 1 wherein the weight average molecular weight of said offset preventing agent is 50,000 to 500,000.

* * * * *